US011365572B2

(12) United States Patent
Ellefred et al.

(10) Patent No.: US 11,365,572 B2
(45) Date of Patent: Jun. 21, 2022

(54) DOOR-OPERATING ASSEMBLY

(71) Applicants: Joerg Ellefred, Rheda-Wiedenbrueck (DE); Felix Kaupmann, Rheda-Wiedenbrueck (DE)

(72) Inventors: Joerg Ellefred, Rheda-Wiedenbrueck (DE); Felix Kaupmann, Rheda-Wiedenbrueck (DE)

(73) Assignee: SIMONSWERK GMBH, Rheda-Wiedenbrueck (DE)

( * ) Notice: Subject to any disclaimer, the term of this patent is extended or adjusted under 35 U.S.C. 154(b) by 373 days.

(21) Appl. No.: 16/736,952

(22) Filed: Jan. 8, 2020

(65) Prior Publication Data

US 2020/0224470 A1 Jul. 16, 2020

(30) Foreign Application Priority Data

Jan. 11, 2019 (DE) ..... 102019100643

(51) Int. Cl.
*E05C 19/16* (2006.01)
*E05B 15/00* (2006.01)
(Continued)

(52) U.S. Cl.
CPC ..... *E05C 19/163* (2013.01); *E05B 15/0073* (2013.01); *E05B 47/004* (2013.01);
(Continued)

(58) Field of Classification Search
CPC ..... E05C 19/163; E05C 17/56; E05C 19/16; E05C 19/166; E05B 15/0073;
(Continued)

(56) References Cited

U.S. PATENT DOCUMENTS 3,326,588 A 6/1967 Clark
3,837,195 A * 9/1974 Pelto ..... E05B 47/0038 70/276

(Continued)

FOREIGN PATENT DOCUMENTS

DE 202004009405 U 9/2004
EP 2527573 A1 * 11/2012 ..... E05C 17/56
WO WO-2017181072 A1 * 10/2017 ..... E05B 47/0038

*Primary Examiner* — Kristina R Fulton
*Assistant Examiner* — Tal Saif
(74) *Attorney, Agent, or Firm* — Andrew Wilford

(57) ABSTRACT

A door-operating assembly has first and second subassemblies each having a housing, a magnet, a sleeve carrying the sleeve and rotatable in the respective housing about an axis, an actuator for rotating the first sleeve about the respective axis, and a rotation limiter restricting rotation of the respective sleeve and magnet. The magnets in a first position repel and push the respective sleeves axially away from each other such that the first rotation limiter is effective in a first direction on the first sleeve and the second rotation limiter is effective in a second rotation direction on the second sleeve. Conversely, the magnets in a second position attract and pull the sleeves axially toward each other such that the first rotation limiter is effective against the first rotation direction on the first sleeve and the second rotation limiter is effective against the second rotation direction on the second sleeve.

15 Claims, 7 Drawing Sheets

(51) Int. Cl.
*E05B 47/00* (2006.01)
*E05B 65/00* (2006.01)

(52) U.S. Cl.
CPC ..... *E05B 65/0025* (2013.01); *E05Y 2201/258* (2013.01); *E05Y 2201/42* (2013.01); *E05Y 2201/46* (2013.01)

(58) Field of Classification Search
CPC ..... E05B 47/004; E05B 65/0025; E05B 9/02; E05B 9/08; E05B 9/10; E05B 17/22; E05B 47/00; E05B 47/0038; E05B 47/0042; E05B 63/16; E05B 65/0035; E05Y 2201/258; E05Y 2201/42; E05Y 2201/46; H01F 7/02
USPC ..... 292/251.5; 70/276, 413
See application file for complete search history.

(56) References Cited

U.S. PATENT DOCUMENTS

| | | | | |
|---|---|---|---|---|
| 6,640,398 | B2 * | 11/2003 | Hoffman | A44C 5/2057 70/459 |
| 8,016,330 | B2 * | 9/2011 | Fullerton | H01F 13/003 335/306 |
| 2005/0023841 | A1 * | 2/2005 | Chen | G06F 1/1679 292/251.5 |
| 2007/0007775 | A1 * | 1/2007 | Gallas | E05C 19/16 292/251.5 |
| 2012/0131967 | A1 * | 5/2012 | Sanchez | E05B 47/0038 70/276 |
| 2018/0347228 | A1 | 12/2018 | Mohammed | |
| 2020/0224455 | A1 * | 7/2020 | Ellefred | E05B 47/004 |
| 2020/0226890 | A1 * | 7/2020 | Ellefred | E05B 39/00 |

* cited by examiner 3
2
1b
1a
1
4
x
z
y
6a
5a
5b
6b
4

DOOR-OPERATING ASSEMBLY

FIELD OF THE INVENTION

The present invention relates to a door-operating assembly. More particularly this invention concerns such an assembly usable on a glass door for operating the latch thereof.

BACKGROUND OF THE INVENTION

A door-operating assembly particularly useful on a glass-panel door comprises a first subassembly having a first magnet that is rotatable with a first sleeve about a first axis of rotation, and an actuator for rotating the first sleeve. Coupled therewith is a second subassembly having a second magnet that is rotatable with a second sleeve about a second axis of rotation, and a second actuator for rotating the second sleeve.

Door control assemblies with two magnetically coupled door subassemblies are used especially for all-glass door panels. They enable forces to be transferred through the closed surface of a door panel. As a result, recesses or holes, which may otherwise lead to damage to the glass door body, are superfluous.

For example, a door assembly is known from DE 20 2004 009 405 in which a conventional mechanical door lock is mounted on a face of the door panel. The current closed position of the door lock is transmitted to the opposite side by a magnet arrangement. In this case, the display unit can also be used for emergency release. However, this must be based on the transmission of magnetic force through the door panel. If the frictional and resistance forces of the mechanical lock exceed the magnetic coupling forces between the two subassemblies, an emergency release is not possible. Secure opening and closing on both sides cannot be guaranteed with this arrangement.

OBJECTS OF THE INVENTION

It is therefore an object of the present invention to provide an improved door-operating assembly.

Another object is the provision of such an improved door-operating assembly that overcomes the above-given disadvantages, in particular that improves on the possible applications of a magnetic coupling between two door subassemblies so that actuation is equally possible from both sides and haptic feedback is given about the current operating state of the subassemblies.

SUMMARY OF THE INVENTION

A door-operating assembly comprises according to the invention a first subassembly having a first housing, a first magnet, a first sleeve carrying the first sleeve and rotatable in the first housing about a first axis, a first actuator for rotating the first sleeve about the first axis, and a first rotation limiter restricting rotation of the first sleeve and magnet. Similarly a second subassembly has a second housing, a second magnet, a second sleeve carrying the second sleeve and rotatable in the second housing about a second axis, a second actuator for rotating the second sleeve about the second axis, and a second rotation limiter restricting rotation of the second sleeve and magnet. According to the invention the magnets in a first functional position repel each other and push the respective sleeves axially away from each other such that the first rotation limiter is effective in a first direction on the first sleeve and the second rotation limiter is effective in a second rotation direction on the second sleeve. Conversely, the magnets in a second functional position attract each other and pull the sleeves axially toward each other such that the first rotation limiter is effective against the first rotation direction on the first sleeve and the second rotation limiter is effective against the second rotation direction on the second sleeve.

In other words, due to the axial magnetic repulsion, the first rotation limiter is effective in a first direction of rotation and the second rotation limiter is effective in a second direction of rotation. The first direction of rotation and the second direction of rotation can be in the same direction or in opposite directions relative to one another. In a second functional state, the first magnet and the second magnet attract one another axially together. As a result, the first rotation limiter is effective counter to a first direction of rotation and the second rotation limiter is effective counter to a second direction of rotation.

The rotation limiters are set up to prevent rotation of the first sleeve and the second sleeve in the direction in which they are effective beyond a certain locked position. If a sleeve that is associated with a rotation limiter is (continuously) effective in a particular direction of rotation, a complete rotation of the sleeve in this direction is not possible, because further rotation is prevented upon reaching the locked position at the latest.

In the context of the present invention, an operating state of the door-operating assembly, particularly the closed position, is represented by the magnetic attraction or repulsion of the two magnets. The information transfer between the first control element and the second control element takes place magnetically.

The rotation limiters can actually communicate the current operating state to a user by haptic feedback. Depending on whether a rotation or a complete rotation of a sleeve is possible in a clockwise or counterclockwise direction, a user can recognize whether the door-operating assembly is in a first functional state or in a second functional state. This behavior is known from conventional mechanical door locks, for example, in which further rotation in the "opening direction" is no longer possible in an opening position, and further rotation in the "closing direction" is no longer possible in a closed position. In the context of the present invention, a corresponding operating behavior can be provided without direct mechanical coupling solely on the basis of magnetic interaction.

In order to achieve the best possible magnetic coupling, the first axis of rotation and the second axis of rotation extend parallel to one another. This also includes smaller deviations with an angle of intersection of no more than 5°. In an especially preferred embodiment, the two axes of rotation are coaxial, so that the first axis of rotation and the second axis of rotation are the same axis.

According to a preferred embodiment of the invention, the first rotation limiter has a first guide that extends angularly extends around the first axis of rotation and a first engagement element that interacts with the first guide. The first sleeve is held so as to be displaceable relative to a housing of the first control element in the direction of the first axis of rotation (axial direction). The first guide has a first longitudinal portion that extends in the axial direction. Upon reaching the longitudinal portion in a first direction of rotation, further rotation is no longer possible. Due to the engagement between the engagement element and the guide, the movement is limited to the axial direction (or to a reverse rotation in the opposite direction). The longitudinal portion thus forms a first stop that is effective in this direction of rotation. If the engagement element interacts with the first longitudinal portion, displacement of the first sleeve in the axial direction is possible. Such a displacement is triggered by the magnetic attraction or repulsion between the first magnet and the second magnet. At the opposite end of the longitudinal portion, the portion that extends in the peripheral direction adjoins in the opposite direction. The guide is thus a one-turn spiral with an axial connector between its ends and forms a second stop there which is effective in the opposite direction of rotation. In the variant described, the direction of action of the rotation limiter can thus be implemented as a function of an attractive or repulsive magnetic interaction.

The guide is preferably a groove. The engagement element can be a projection or pin that is fixed in the respective housing and engages in the groove.

According to a preferred embodiment, the guide is on an outer surface of the rotatable first sleeve. Accordingly, the engagement element is held in a rotationally fixed manner on the housing receiving the sleeve.

The second rotation limiter of the second subassembly is preferably designed accordingly with a second guide, particularly a groove, having a second longitudinal portion and a second engagement element that interacts therewith.

In a preferred embodiment of the invention, a lost-motion coupling is formed between the first actuator and the first sleeve and/or between the second actuator and the second sleeve. The term "lost-motion coupling" is understood to mean that rotational movement of the two elements is coupled in such a way that a relative angle of rotation can be freely set in a certain rotation angle. The lost-motion coupling is limited in both the one and the other direction of rotation by end stops at which the respective actuator and the associated sleeve bear against one another in a form-fitting manner. A further rotation of the actuator in this direction entrains the respective sleeve along with it during the movement. If the rotational movement of the sleeve is blocked in this direction, further rotation of the actuator is also impossible.

The lost-motion coupling preferably has an angular range of at least 90°. If a lost-motion coupling of 90° is possible between the first actuator and the first sleeve and between the second actuator and the second sleeve, the first magnet and the second magnet can be moved at least between a relative positioning that is oriented in the same direction and a relative positioning that is oriented in the opposite direction. Especially preferably, a lost-motion coupling of at least 180° is provided.

The rotational movement of the first sleeve and the rotational movement of the second sleeve are preferably blocked in both directions in the first functional state. This ensures that the magnetic directions of the first magnet and the second magnet are aligned in the same direction, particularly in parallel. In addition to the first rotation limiter of the first sleeve, which is effective in the first direction of rotation, rotational movement of the first sleeve counter to the first direction of rotation is preferably realized through abutment of the first actuator, which is inhibited or locked in its rotational movement, against a stop of the first lost-motion coupling. Analogously, in addition to the blocking of the second sleeve by the second rotation limiter effective in the second direction of rotation, rotation of the second sleeve counter to the second direction of rotation is brought about through abutment of the second actuator that is locked or inhibited in its rotational movement against an associated stop of the second lost-motion coupling. Both the first sleeve and the second sleeve are thus clearly fixed in place in the first functional state. Movement is not possible without actuating the respectively associated drive element or without magnetic polarity reversal, as a result of which the rotation limiters become effective in the opposite direction.

The "first magnet" and "second magnet" are to be understood as permanent magnetized magnet assemblies. In particular, these are each permanent magnets with a north pole and a south pole and, in the case of a bar or cylinder magnet, a south-to-north magnetic direction.

According to a preferred embodiment, the first magnet is a bar magnet whose magnetic direction is oriented perpendicular to the first axis of rotation and the second magnet is as a bar magnet whose magnetic direction is oriented perpendicular to the second axis of rotation. The "alignment" of the magnet is the direction of its leading dipole moment. An alignment can be assumed to be "perpendicular" if an angle of at least 80°, preferably at least 85°, is formed between the dipole moment and the axial direction.

As a result of this orientation of the magnets relative to the axes of rotation associated with them, the magnets can be moved between a same-direction, in particular parallel position and an opposite-direction, in particular antiparallel position. The alignment is to be assumed to be "in the same direction" if the orientation of the first magnet and the orientation of the second magnet, when projected onto a normal plane of one of the axes of rotation, form an angle of less than 90°. At an angle of greater than 90°, the orientation is "in the opposite direction."

In the same-direction position, there is a repulsion between the magnets in the axial direction. At the same time, the dipole far field of the two magnets strengthens to form a stronger overall field. This can also be used to transmit the functional state to a sensor unit or to a mechanical active group, such as a latch. The two magnets (and hence the overall magnetic field) are preferably oriented in the direction of the sensor unit or active group. In an inverse arrangement, the two magnets attract each other in the axial direction. The magnetic far field is reduced, which can also be used for the purpose of transmission.

Due to the magnetic coupling of the first subassembly with a second subassembly, direct contact is not necessary. The first subassembly is thus preferably mounted at a spacing from the second subassembly. In particular, an additional assembly, an all-glass door panel, for example, can be arranged in the space between the first subassembly and the second subassembly. It is not necessary for holes to be cute through the panel with this interposed assembly.

According to a preferred embodiment of the invention, the first actuator and the second actuator can each be locked in a base position and rotated through full revolutions relative to this base position. In particular, the actuators have a latch, in particular a cylinder lock. In the base position, a fitting key can be inserted into the respective latch, thereby releasing the locking of the actuator. After turning one or more complete turns, the key can only be removed again in the base position. The rotational mobility of the first actuator is then locked again in this base position.

According to a preferred embodiment, the first subassembly and the second subassembly are embodied so as to be point-symmetrical or mirror-inverted relative to one another. The alignment of the magnets can deviate from this.

The invention also relates to a door with a door panel that can be moved between an open position that releases the door opening at least partially and a closed position that closes the door opening. The door panel extends in a vertical direction, in a horizontal direction, and in a thickness direction. The extension in the thickness direction is substantially less than in the vertical or horizontal direction (at least by a factor of 10). In an ordinary assembled position, the vertical direction is essentially parallel to the direction of gravitational force. The door panel is closed in the horizontal direction by two end faces that form side edges. According to the invention, the door has a previously described door-operating assembly, the first subassembly being mounted on a first face of the door panel and the second subassembly being mounted on a second face of the door panel that is situated opposite the first face in the thickness direction. The coupling of the first subassembly with the second subassembly can occur through the door panel solely on the basis of magnetic interaction. Without restricting the invention, the door panel can be embodied in particular as a swing or sliding door panel.

Therefore, the door panel preferably has an extension of no more than 2 cm in the thickness direction. Thin door panels are especially suitable for use with the magnetically coupled subassemblies.

According to an especially preferred embodiment, the door panel is designed to be continuous and imperforate at least in the area of the first subassembly and second subassembly. No openings or through holes are arranged in this area. This eliminates the need to provide such openings when manufacturing the door panel or to add them later. This eliminates the additional time and effort and the risk of damaging or destroying the door panel during such a processing step.

This advantage becomes particularly evident when, according to a preferred embodiment, the door panel is wholly of glass. The subsequent processing of glass door panels, particularly those made of safety glass, ranges from complex to impossible. The omission of recesses and openings in such door panels is therefore generally desirable.

The door preferably has a latch. This can be switched by magnetic interaction with the door control arrangement between a locked state in which the door panel is locked in the closed position and a release state in which the door panel is unblocked. The magnetic interaction takes place with the magnetic field of the first magnet and/or of the second magnet.

According to a preferred embodiment, the latch and the subassemblies are designed and mounted in such a way that the door subassembly brings the latch into the locking state in the first functional state. In the first functional state, the first magnet and the second magnet repel one another magnetically in the axial direction. The far field of the combination of the first magnet and the second magnet thus increases. The magnetic combined field strengthened in this manner is suitable for triggering a closing action in the closing element.

The release state of the latch is more preferably achieved when the external magnetic field, induced by the combination of the first magnet and the second magnet, is weak or vanishingly small. Such an embodiment has the advantage that the subassembly can be brought into the first functional state that induces the closing process even when the door panel is outside the closed position. The door then locks when the door panel reaches the closed position. In contrast to mechanical door locks, a renewed mechanical interaction is not necessary.

According to an especially preferred embodiment, the latch is mounted in a jamb surrounding the door opening. The locking effect on the door panel can then be achieved in particular by means of a form fit with the door panel body itself or with a strike plate mounted thereon.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
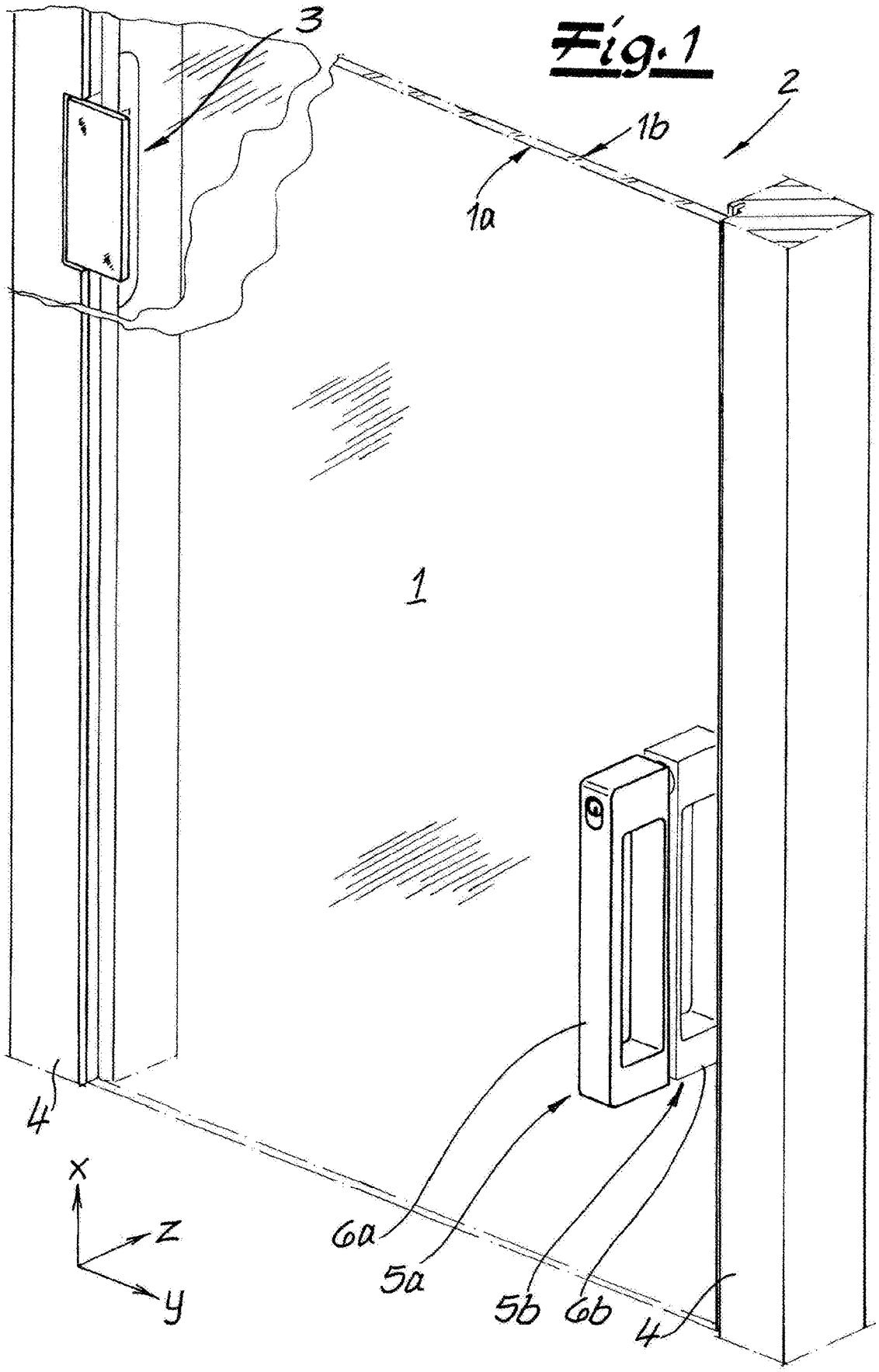
FIG. 1 is a perspective view of a part of a door having an operating assembly according to the invention.

As seen in FIG. 1, a door according to the invention has a door panel 1 that can be moved between an open position that clears a door opening 2 at least partially and a closed position (shown here) that blocks the door opening 2. The door panel 1 extends in a vertical direction x, a horizontal direction y parallel to a plane of the panel 1, and a horizontal thickness direction z perpendicular to directions x and y. In the illustrated embodiment, the door panel 1 can pivot between the open position and the closed position supported by at least one door hinge 3 about a vertical pivot axis parallel to the vertical direction x. The door opening 2 is bordered horizontally by a door jamb 4 that in the illustrated closed position receives the door panel 1, which here is entirely formed of glass. A first front face 1*a* of the door panel 1 is substantially flush with the level of the jamb 4 with an offset of less than half a centimeter. The jamb 4 carries a magnetically operable latch 19 as described in copending US patent application based on DE 10 2019100637.6, whose disclosure is herewith incorporated by reference.

According to the invention, a first subassembly 5*a* is mounted on a first face 1*a* of the door panel 1. A second subassembly 5*b* is attached to a second face 1*b* that faces oppositely away from the first face 1*a*. The first subassembly 5*a* and the second subassembly 5*b* are substantially identical and each have a housing 6*a* or 6*b* formed as a handle. The first and second subassemblies 5*a* and 5*b* are basically identical.

Figure 2:
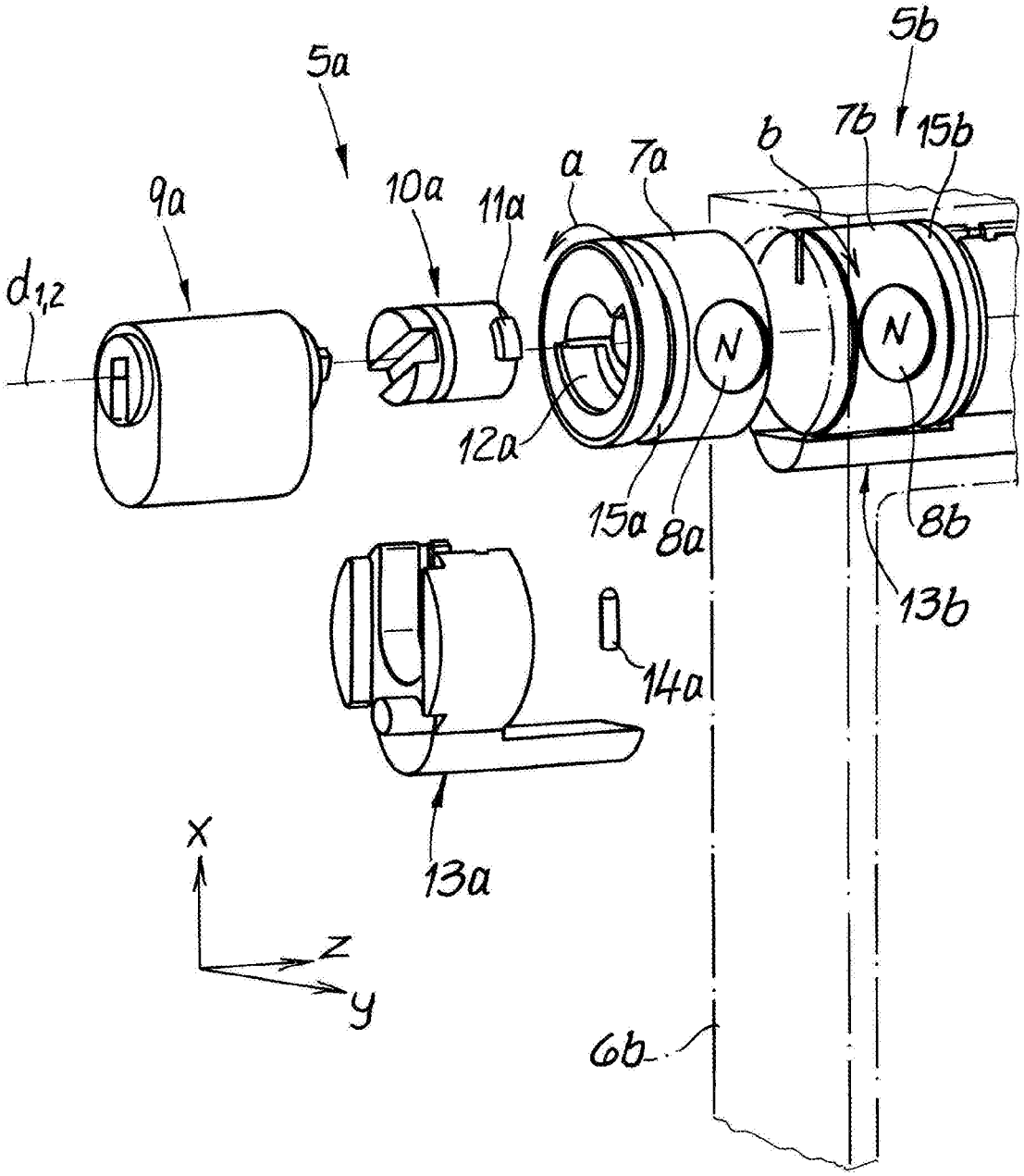
FIG. 2 a large-scale perspective exploded view of details of elements of the operating assembly.

FIG. 2 shows the first subassembly 5*a* in an exploded view without the housing 6*a*. In the regular arrangement, the oppositely situated housing 6*b* is as shown by broken lines with the components that are accommodated therein. The first subassembly 5*a* comprises a first sleeve 7*a* in which a first magnet 8*a* is guided so as to be rotatable about an axis of rotation $d_1$ that extends in the thickness direction z. This magnet 8*a* is a bar magnet whose magnetic direction is perpendicular to the axis $d_1$ The second subassembly 5*b* is magnetically coupled to the first subassembly 5*a* and has a second sleeve 7*b* holding a second magnet 8*b* rotatable about an axis of rotation $d_2$ coaxial to the axis $d_1$. The first sleeve 7*a* and the second sleeve 7*b* each have a cylindrical outer surface that is held in a complementary cylindrical seat of the respective housing 6*a*, 6*b* and can be rotated about the respective axis of rotation $d_1$ or $d_2$.

The first sleeve 7*a* can be rotated by an actuator that in this embodiment is formed by a first cylinder lock 9*a* and a first coupling 10*a*. The cylinder lock 9*a* is in the position shown here when a key is not inserted into it, and neither it nor its coupling 10*a* cannot rotate. Furthermore, a first dog 11*a* is also provided on the outside of the coupling 10*a* that engages in an associated recess 12*a* of the first sleeve 7*a*. The recess 12*a* is of substantially greater angular size than the dog 11*a*, so that the first sleeve 7*a* can rotate relative to the coupling 10*a* with a lost motion of approximately 180°. The coupling 10*a* has a cylindrical middle part that fits complementarily in an at least partially cylindrical hole of the sleeve 7*a*. The dog 11*a* projects radially therefrom. In the axial direction of the first axis of rotation $d_1$, the recess 12*a* is deeper than the extension of the dog 11*a*. This enables the first sleeve 7*a* to move axially relative to the coupling 10*a*.

The coupling 10*a* is held by and rotatable in a holder 13*a* in the axial direction $d_1$/z. The holder 13*a* also carries a pin 14*a*. This pin 14*a* is part of a first rotation limiter. The rotation limiter further comprises a radially outwardly open groove 15*a* formed on the sleeve 7*a*.

As indicated in FIG. 2, the magnets 8*a*, 8*b* are bar magnets that are aligned in parallel in the horizontal direction y. The north pole at the end is indicated by a letter N. As a result, there is repulsion between the first sleeve 7*a* and the second sleeve 7*b* in the direction of the common axis of rotation $d_1/d_2$ to push these sleeves 7*a* and 7*b* axially away from each other in their base positions.

Figure 3:
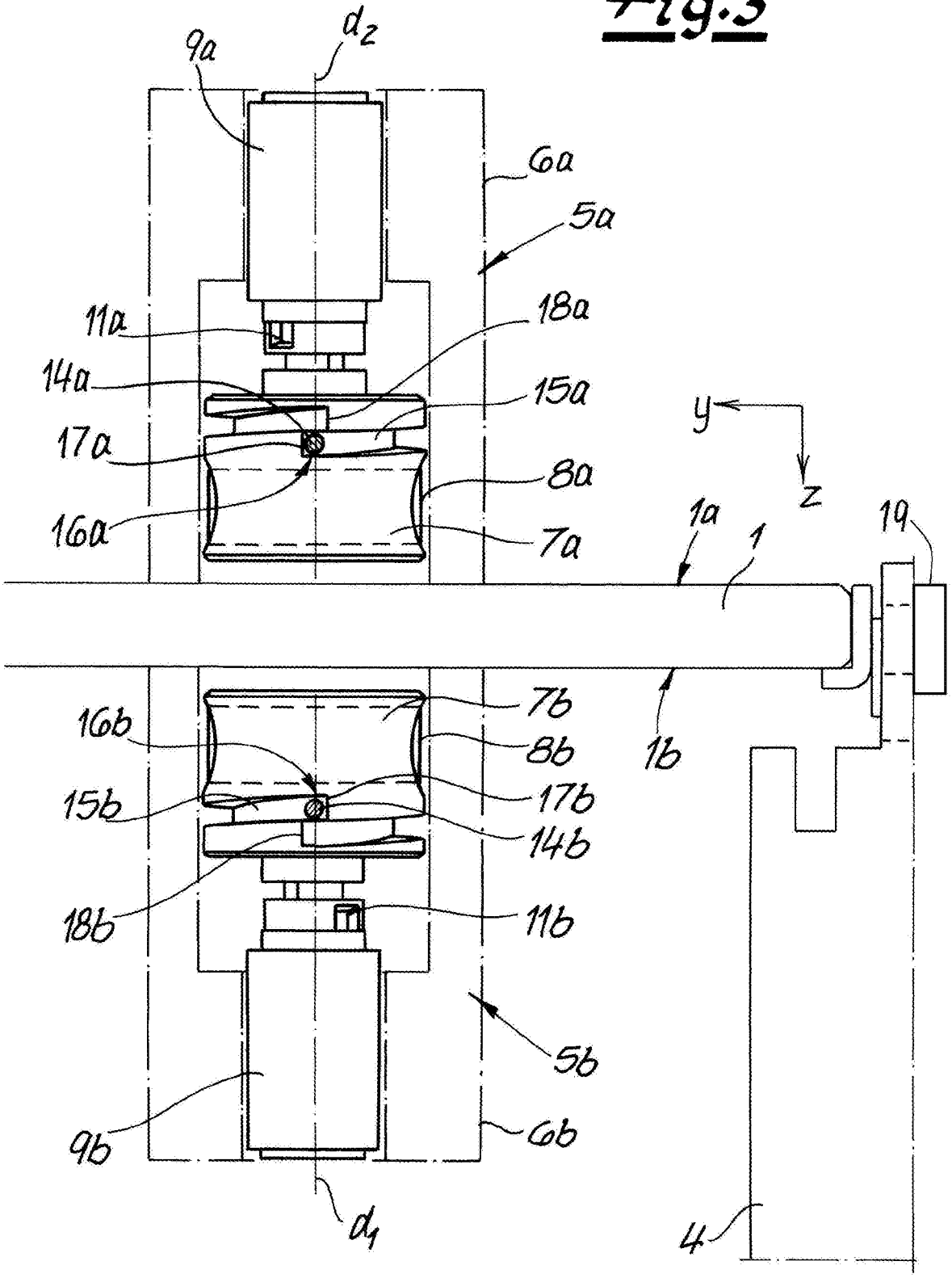
FIG. 3 is a sectional bottom view of the operating assembly.

The mode of action of the first rotation limiter 14*a*, 15*a* can be seen from FIG. 3. The first guide groove 15*a* is a one-turn spiral and has an inner portion 16*a* that extends in the axial direction d/z. The groove 15*a* thus forms a step-shaped shoulder with a first end stop 17*a* and a second end stop 17*b*.

In the illustrated first functional state, the first sleeve 7*a* and the second sleeve 7*b* are each displaced outward away from the door panel 1 due to magnetic repulsion. In the same rotational position, in which the first pin 14*a* is positioned in the first longitudinal portion 16*a* and the second pin 14*b* is positioned in the second longitudinal portion 16*b*, the transition to a second position in which the distance between the respective sleeve and the door panel 1 is smaller is also possible, depending on the axial magnetic attraction or repulsion. Since, in the illustrated functional state, the pin 14*a* bears against the first stop 17*a*, it is not possible to turn it counterclockwise (when viewing the first front face 1*a* of the door panel 1). The first rotation limiter is thus effective in this state in the first direction of rotation a. In the event of an axial attraction, the pin 14*a* would come into contact with the second stop 17*b*, so that the first rotation limiter 14*a* would be effective counter to the first direction of rotation a.

As can be seen from a comparative examination of FIGS. 2 and 3, the second control element 5*b* is identical to the first control element 5*a* and is attached to the opposite face 1*b*, but offset by 180° about the vertical axis x. Only the relative orientation of the magnet differs, so that, in the first functional state shown, the first magnet 8*a* and the second magnet 8*b* are parallel to one another as regards their magnetic directions. The corresponding assemblies of the second subassembly 5*b* each have the same reference numerals, these being provided with the index "b." It is clear that the second direction of rotation, in which the second turnstile arrangement 14*b*, 15*b* is effective in the first illustrated functional state, is also counterclockwise when viewed toward the respective face 1*b* of the door panel. In absolute terms, the first direction of rotation a is opposite the second direction of rotation b.

The switching function between the first functional state is shown in FIGS. 4A to 4G. The views are each to be understood as a schematic with a view of the first front face 1*a* of the door panel seen in the thickness direction z. The relevant parts of the first subassembly 5*a* are shown in the left half of the figure, and the corresponding parts of the second subassembly 5*b*, which are arranged behind them, are shown in the right half of the figure. In particular, this explains the interaction of the actuator, the lost-motion coupling, and the respective rotation limiters. For better visibility, the successively arranged components of the first control assembly 5*a* and the second control assembly 5*b* are shown side by side in the illustration.

Figure 4A:
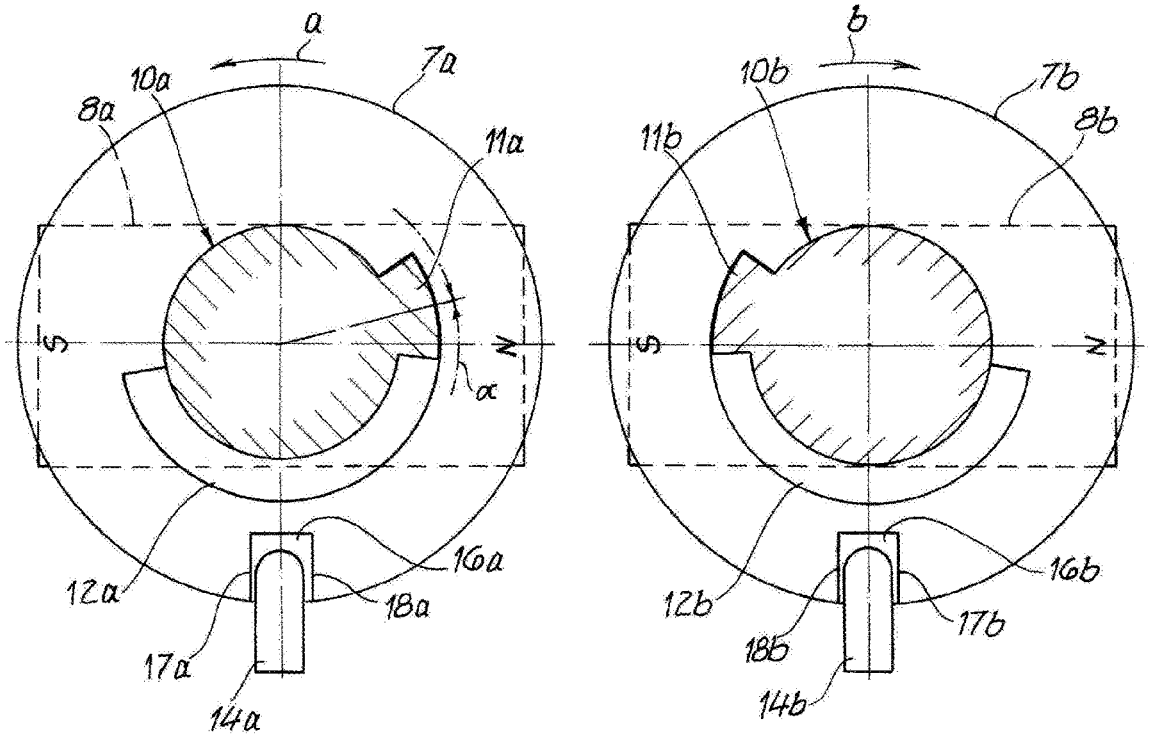
FIGS. 4A-4G are views illustrating how the operating assembly works.

The basic state corresponding to the first functional state is shown in FIG. 4A. Both the first sleeve 7*a* and the second sleeve 7*b* are thus clearly fixed in place in the first functional state. The first sleeve 7*a* is blocked from rotating in the first direction of rotation a by the interaction of the first stop 17*a* with the first pin 14*a*. Rotation of the first sleeve 7*a* counter to the first direction of rotation a is, in turn, blocked by the form-fitting engagement of the first dog 11*a* with the recess 12*a* forming the lost-motion coupling. Accordingly, the second sleeve 7*b* locks in the second direction of rotation b through the third stop 17*b* in conjunction with the second pin 14*b* and in the opposite direction through interaction of the second dog 11*b* with the second recess 12*b*. In this position, further rotation of the first coupling 10*a*, 11*a* in the first direction of rotation a and further rotation of the second coupling 10*b*, 11*b* in the second direction of rotation b are both prevented, since the respective direction of rotational locking is active there.

In the depicted embodiment, the first functional position represents the closed position of the door subassembly that is a magnetic door lock. The first direction of rotation a of the first door subassembly and the second direction of rotation b of the second subassembly each represent a "closing direction." Further rotation in this direction from the closed position is prevented.

In the illustrated embodiment, the closing direction is therefore defined as a counterclockwise direction both from the first front face 1*a* of the door panel and from the second front face 1*b* of the door panel. In order to adapt to a standard user experience in which the closing direction is "toward the door jamb" on both faces, an angle gear can be provided in the actuator 9*a* of the first subassembly 5*a*, which reverses the direction of rotation of the key upon transmission to the dog 11*a*.

Figure 4B:
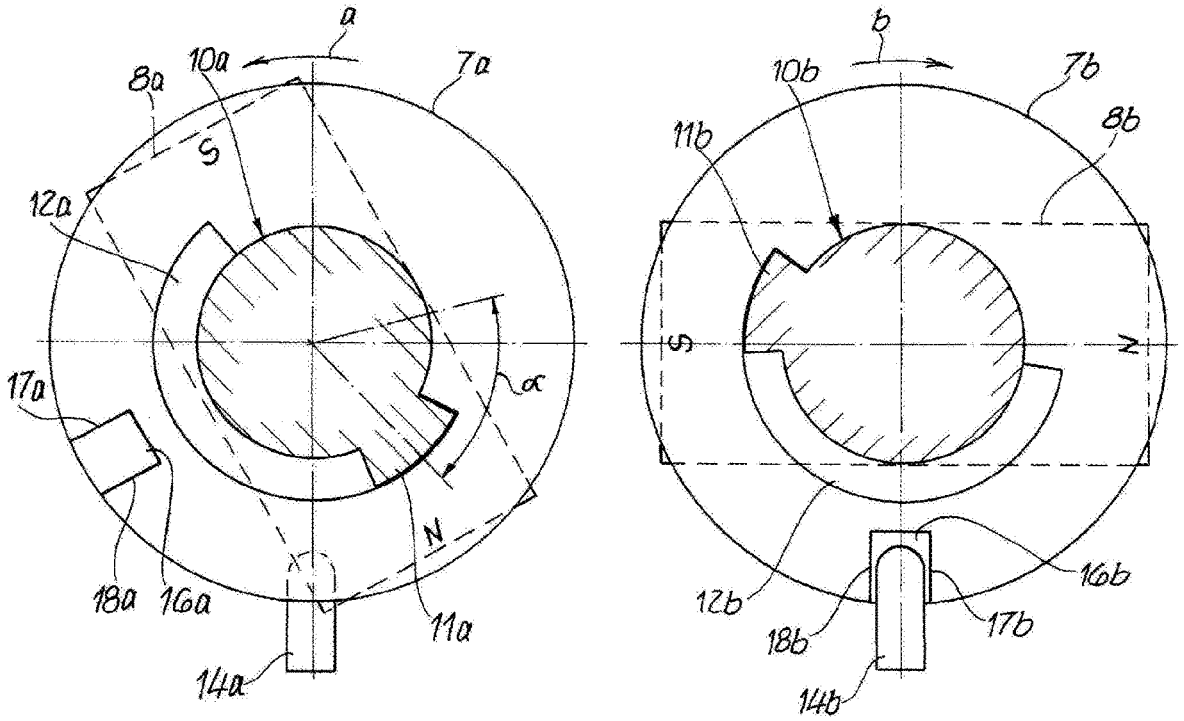

FIG. 4B shows a functional position in which the first coupling 10*a*, 11*a* is rotated by an angle of approximately 60° counter to the first direction of rotation a. Due to the repulsive torque between the first magnet 8*a* and the second magnet 8*b*, the first sleeve 7*a* is entrained in spite of the existing lost-motion coupling. Rotation of the second sleeve 7*b* is blocked on both sides, so that the second half of the view remains unchanged. In this position, the first magnet 8*a* and the second magnet 8*b* are still arranged in the same direction, so the axial repulsion reaction continues.

Figure 4C:
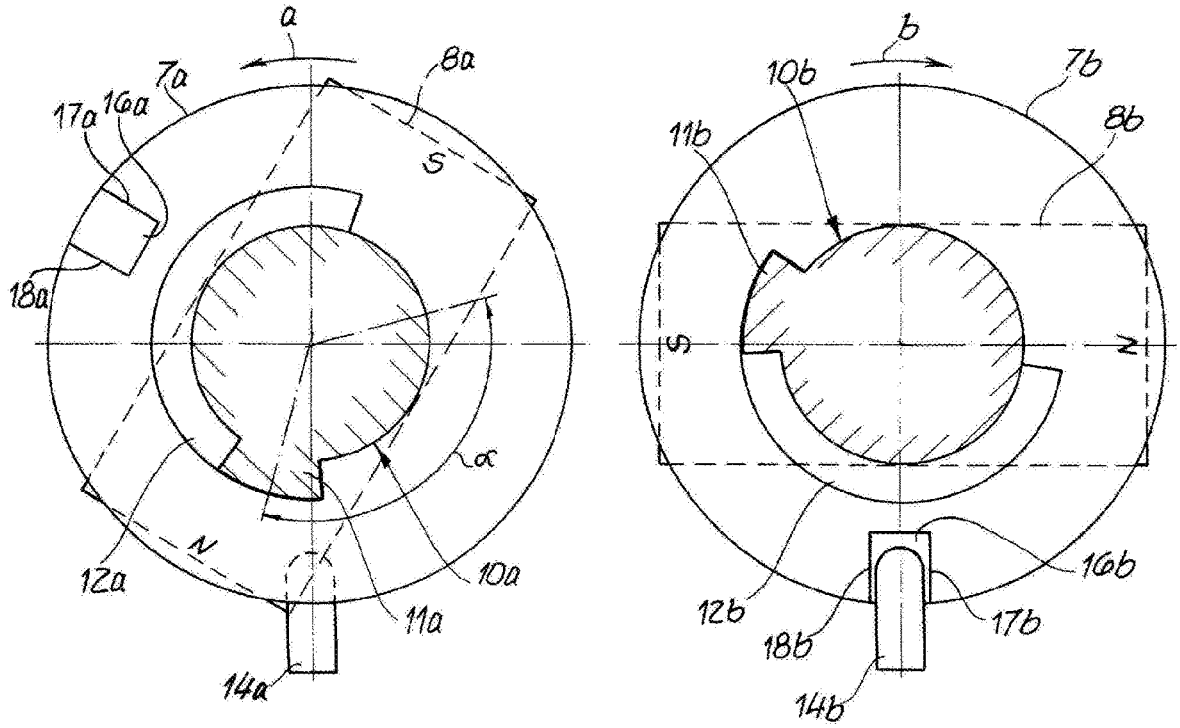

In FIG. 4C, the orientation of the first magnet 8*a* and the orientation of the second magnet 8*b* form an angle of approximately 120°. They can thus be regarded as being arranged "in opposite directions," which results in an axial attraction. As a result, the direction of action of the second rotation limiter changes: now the second pin 14*b* is in contact with the fourth stop 18*b*, so that both the locking device that is formed with the groove 15*b* and the pin 14*b* as well as the form fit between the second dog 11*b* and the recess 12*b* of the second sleeve 7*b* prevent rotation counter to the second direction of rotation d. However, the torque acting on the second sleeve 7*b* is oriented exactly in this direction, so that no movement occurs.

Figure 4D:
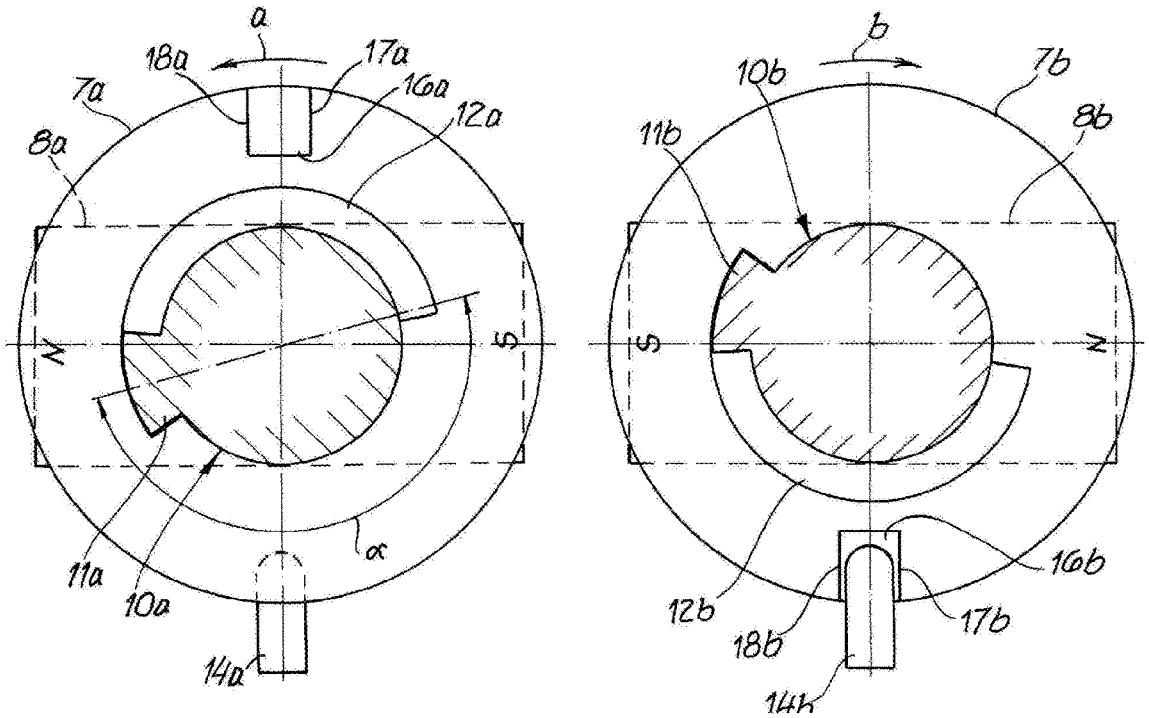

In FIG. 4D, an angle $\alpha$ of rotation of the first drive relative to the base position of approximately 180° has been reached. Here, the magnetic directions first magnet 8*a* and second magnet 8*b* are aligned parallel but opposite to each other. The axial attraction that is exerted is maximal. The mutually interacting magnetic torques disappear.

Figure 4E:
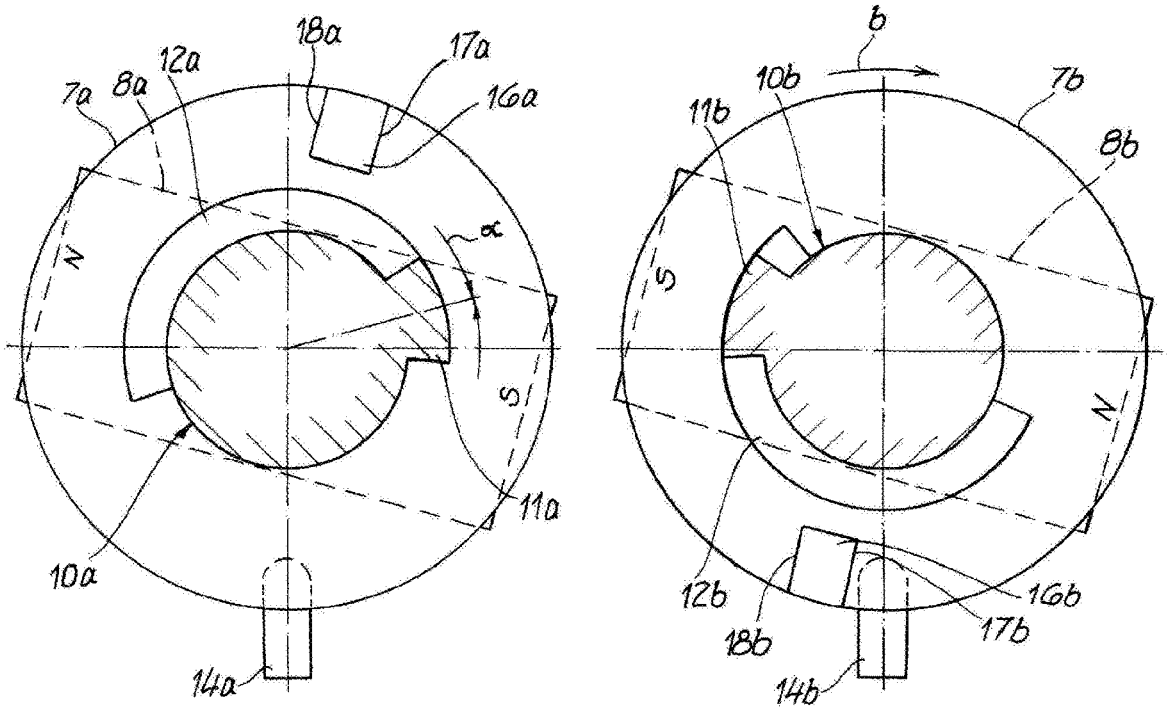

Upon further rotation, the first dog 11*a* now moves within the lost-motion coupling, whereas the first sleeve 7*a* does not move farther. Only when the end position (angle of rotation $\alpha$ of 360°) is reached does the first dog 11*a* reach the right-hand stop of the lost-motion coupling and carry the first sleeve 7*a* along with it for a small angular amount. Since the second rotation limiter acts counter to the second direction of rotation b when in the tightened state (second functional state), the second sleeve 7*b* can also rotate by a corresponding angular amount, as is shown in FIG. 4E. In this closed position, any key can be removed from the first lock 9*a* again because a complete revolution has been carried out.

Figure 4F:
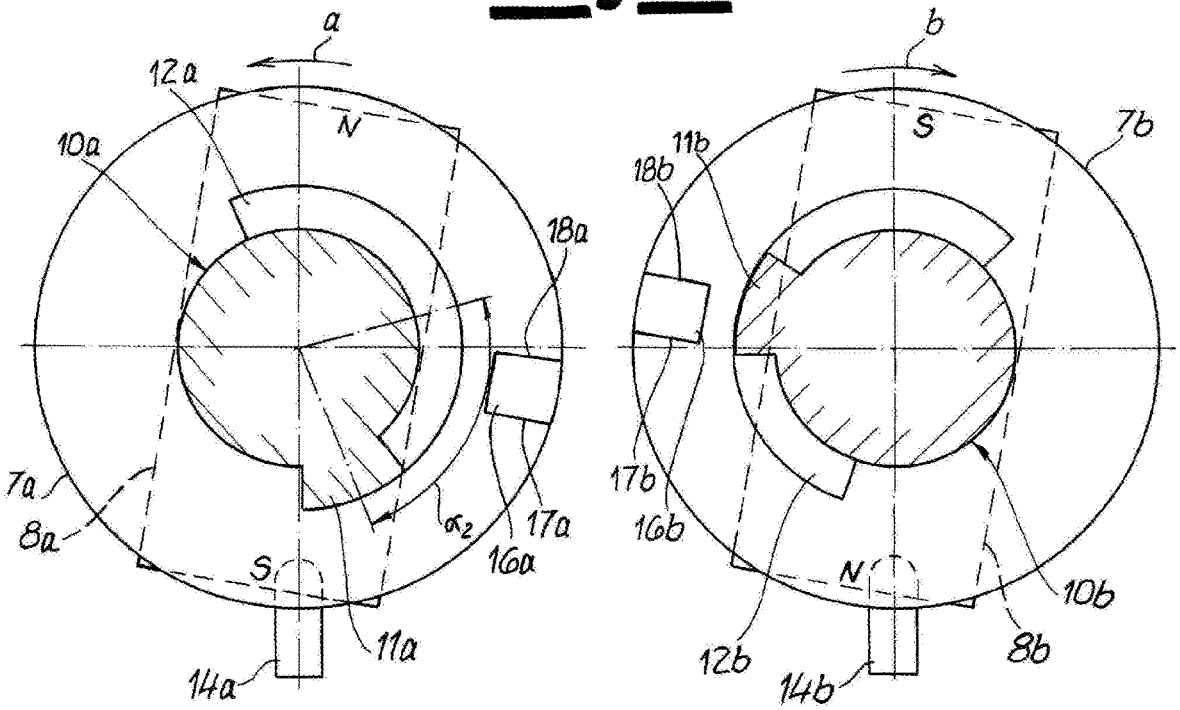
Figure 4G:
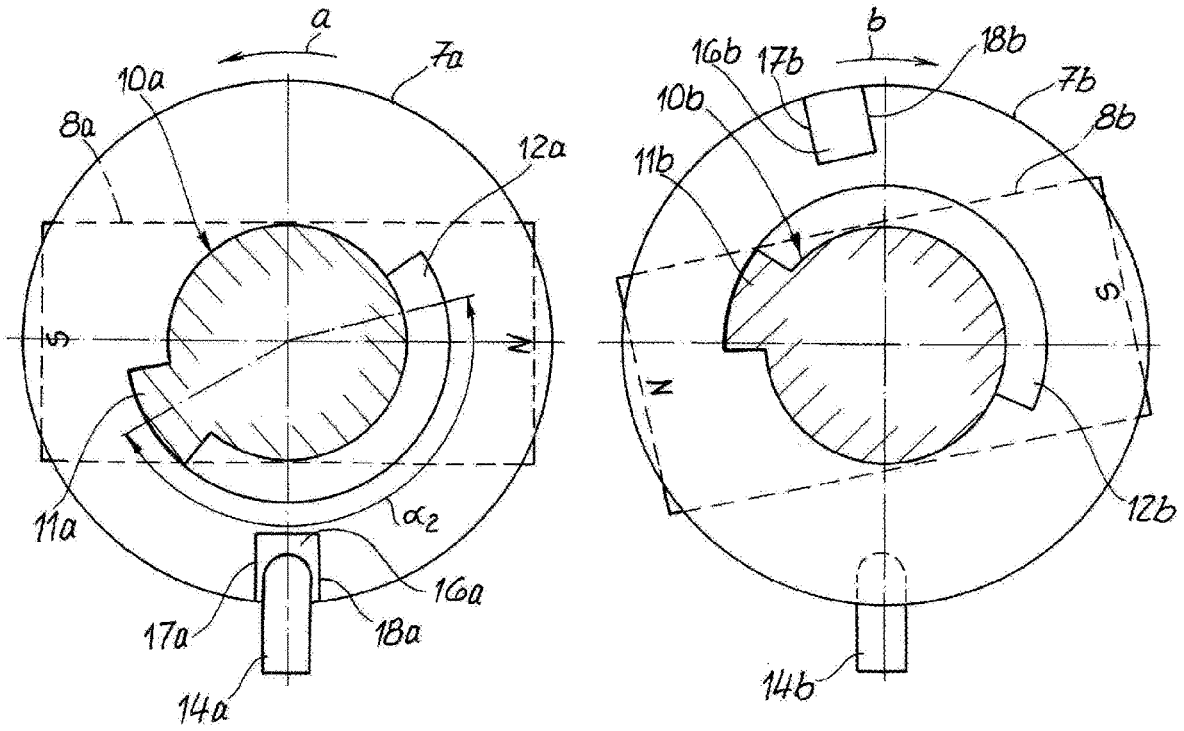

The first magnet 8*a* and the second magnet 8*b* are arranged in opposite directions, antiparallel, so that a second functional state is formed. From this functional position, further rotation of the first drive 9*a*, 10*a* counter to the first direction of rotation a by one complete revolution is not possible. First, as shown in FIG. 4F, both the first sleeve 7*a* and the second sleeve 7*b* are rotated (due to magnetic coupling). At a second angle $\alpha_2$ of rotation of approximately 165°, the pin 14*a* again reaches the position of the longitudinal portion 16*a*. Due to the attractive interaction between the first magnet 8*a* and the second magnet 8*b*, the rotation limiter is effective counter to the first direction of rotation a. The pin 14*a* thus comes into contact with the second stop 18*a*, so that further rotation is prevented. This situation is illustrated in FIG. 4G. It is therefore possible to leave the second functional state (FIG. 4E) only in the first direction of rotation a (closing direction). This replicates the haptic feedback of a conventional lock that can be operated on both sides.

We claim:

1. A door-operating assembly comprising:

a first subassembly having a first housing, a first magnet, a first sleeve carrying the first magnet and rotatable in the first housing about a first axis, a first actuator for rotating the first sleeve about the first axis, and a first rotation limiter restricting rotation of the first sleeve and magnet; and a second subassembly having a second housing, a second magnet, a second sleeve carrying the second magnet and rotatable in the second housing about a second axis, a second actuator for rotating the second sleeve about the second axis, and a second rotation limiter restricting rotation of the second sleeve and magnet, the magnets in a first functional position repelling each other and pushing the respective sleeves axially away from each other such that the first rotation limiter is effective in a first rotation direction on the first sleeve and the second rotation limiter is effective in a second rotation direction on the second sleeve, the magnets in a second functional position attracting each other and pulling the sleeves axially toward each other such that the first rotation limiter is effective against the first rotation direction on the first sleeve and the second rotation limiter is effective against the second rotation direction on the second sleeve.

2. The door-operating assembly according to claim 1, wherein the first axis and the second axis extend parallel.

3. The door-operating assembly according to claim 1 wherein the first rotation limiter has a first angularly extending guide and an engagement element on the first housing and riding in the first guide, the first sleeve being displaceable relative to the first housing along the first axis, the first guide having a first axially extending portion.

4. The door-operating assembly according to claim 3 wherein the first guide is a part-spiral groove on the first sleeve and that the first engagement element is a pin that is mounted in a rotationally fixed manner on the first housing and engages in the first groove.

5. The door-operating assembly according to claim 1, further comprising:

a first lost-motion coupling between the first actuator and the first sleeve; and a second lost-motion coupling between the second actuator and the second sleeve.

6. The door-operating assembly according to claim 5, wherein each lost-motion coupling has a lost motion of at least 90°.

7. The door-operating assembly according to claim 1, wherein the first magnet has a magnetic direction perpendicular to the first axis and the second magnet has a magnetic direction perpendicular to the second axis.

8. The door-operating assembly according to claim 1, wherein the first and second subassemblies are spaced from each other.

9. The door-operating assembly according to claim 8 wherein the axes are coaxial.

10. The door-operating assembly according to claim 1 wherein the first and second actuators are each lockable in a respective base position and can be rotated through 360° therefrom when unlocked.

11. In combination with the door assembly of claim 1, a door panel having a pair of faces;

a door jamb forming a door opening freeable and closable by the door panel, the subassemblies each being mounted on a respective one of the faces of the door directly opposite each other.

12. The combination according to claim 11, wherein the panel is wholly of glass.

13. The combination according to claim 12 wherein the subassemblies are mounted on the respective faces and do not extend into the panel.

14. The combination according to claim 11, further comprising:

a latch on the jamb juxtaposable with the assembly in a closed position of the door panel.

15. The combination according to claim 14, wherein the latch is magnetically operable by the first and second magnets without contact with either of the subassemblies.

* * * * *